US008323129B1

(12) United States Patent
Meyer et al.

(10) Patent No.: US 8,323,129 B1
(45) Date of Patent: Dec. 4, 2012

(54) PROCESS FOR MAKING COMPOSITE ATHLETIC SHAFT

(76) Inventors: Rene P. Meyer, Livermore, CA (US); Scott D. Patterson, Pleasanton, CA (US)

( * ) Notice: Subject to any disclaimer, the term of this patent is extended or adjusted under 35 U.S.C. 154(b) by 0 days.

(21) Appl. No.: 12/564,777

(22) Filed: Sep. 22, 2009

Related U.S. Application Data

(63) Continuation of application No. 11/460,973, filed on Jul. 29, 2006, now Pat. No. 7,614,969.

(60) Provisional application No. 60/710,643, filed on Aug. 23, 2005, provisional application No. 60/716,911, filed on Sep. 14, 2005.

(51) Int. Cl.
*A63B 59/02* (2006.01)
*A63B 65/12* (2006.01)

(52) U.S. Cl. ..... 473/513; D21/724

(58) Field of Classification Search ..... 473/505, 473/512, 513; D21/724
See application file for complete search history.

(56) References Cited

U.S. PATENT DOCUMENTS

| | | | | | |
|---|---|---|---|---|---|
| 3,702,702 | A | * | 11/1972 | Hoult | 473/513 |
| 3,876,204 | A | | 4/1975 | Moore et al. | |
| 4,032,143 | A | | 6/1977 | Mueller et al. | |
| 4,037,841 | A | | 7/1977 | Lewis, Jr. | |
| 4,295,263 | A | * | 10/1981 | Davis | 29/561 |
| 4,671,508 | A | | 6/1987 | Tetreault | |
| 4,739,994 | A | | 4/1988 | Lewis, Jr. | |
| 5,024,866 | A | * | 6/1991 | Goode | 428/36.4 |
| 5,217,221 | A | * | 6/1993 | Baum | 473/561 |
| 5,333,857 | A | * | 8/1994 | Lallemand | 473/561 |
| 5,458,372 | A | * | 10/1995 | Goode | 280/819 |
| 5,556,677 | A | | 9/1996 | Quigley | |
| 5,688,571 | A | | 11/1997 | Quigley et al. | |
| 5,888,601 | A | | 3/1999 | Quigley et al. | |
| 6,129,962 | A | | 10/2000 | Quigley et al. | |
| 6,361,451 | B1 | | 3/2002 | Masters et al. | |
| 6,702,697 | B1 | | 3/2004 | Lussier et al. | |
| 6,752,730 | B1 | | 6/2004 | Brine, Jr. | |
| 6,767,299 | B1 | | 7/2004 | Chang | |
| 6,939,257 | B2 | | 9/2005 | Titola | |
| 7,147,580 | B2 | | 12/2006 | Nutter et al. | |
| 7,614,969 | B2 | * | 11/2009 | Meyer et al. | 473/513 |

(Continued)

FOREIGN PATENT DOCUMENTS

| | | |
|---|---|---|
| CA | 2231908 | 9/1999 |

(Continued)

OTHER PUBLICATIONS

Webpage download, aerosleeves,2004,web.archive.org/web/20040820073110/www.aerosleeves.com/tut.php?print=1, 13 pages.*

Webpage download, soller,2005,http://web.archive.org/web/20050801014424/www.solarcomposites.com, 9 pages.*

*Primary Examiner* — Gene Kim
*Assistant Examiner* — M Chambers
(74) *Attorney, Agent, or Firm* — Aka Chan LLP

(57) ABSTRACT

An elongated shaft has a shock-absorbing core, a fiber-reinforced durable plastic outer skin encasing the core, and an elongated stiffening member encased within the core. The elongated stiffening member may be a spar or a hollow tube. If it is a hollow tube, the tube may contain a weight that moves along the inside of the tube as the shaft is swung. The shaft also has a way to attach athletic equipment, such as a lacrosse head frame and net or hockey blade, to one end.

17 Claims, 6 Drawing Sheets

U.S. PATENT DOCUMENTS

| | | | | |
|---|---|---|---|---|
| 2004/0084815 | A1* | 5/2004 | Blotteaux | 264/512 |
| 2004/0116217 | A1 | 6/2004 | Morrow | |
| 2004/0248675 | A1 | 12/2004 | Brock et al. | |
| 2005/0096159 | A1 | 5/2005 | Houston et al. | |
| 2005/0153799 | A1 | 7/2005 | Rigoli | |
| 2005/0272521 | A1 | 12/2005 | Tsai | |
| 2005/0277494 | A1* | 12/2005 | Goss | 473/513 |
| 2006/0009318 | A1 | 1/2006 | Hayden et al. | |
| 2006/0046866 | A1 | 3/2006 | Rigoli | |
| 2007/0004541 | A1 | 1/2007 | Price et al. | |

FOREIGN PATENT DOCUMENTS

| | | |
|---|---|---|
| CA | 2509254 | 12/2005 |
| DE | 19832542 | 2/2000 |
| GB | 2306335 | 5/1997 |
| WO | 9920357 | 4/1999 |
| WO | 0127244 | 4/2001 |

* cited by examiner

PROCESS FOR MAKING COMPOSITE ATHLETIC SHAFT

CROSS-REFERENCE TO RELATED APPLICATIONS

This patent application is a continuation of U.S. patent application Ser. No. 11/460,973 filed Jul. 29, 2006, which claims priority to U.S. provisional applications 60/710,643, filed Aug. 23, 2005, and 60/716,911, filed Sep. 14, 2005, which are incorporated by reference.

BACKGROUND OF THE INVENTION

This invention relates to a stick having a shaft to which various pieces of athletic equipment can be attached. In particular, it relates to a lacrosse stick having a shock-absorbing core, a durable outer skin encasing the core, and a stiffener encased within the core, and a mounting plate for attaching a lacrosse head frame and net to one end of the shaft.

Lacrosse is a game that originated with the American and Canadian Indians. The game requires a stick to which is attached a small net for catching and throwing a ball. The sticks were originally hand-crafted of wood, usually of hickory, but they lack uniformity as to quality, strength, weight, and feel in the hands of a player. Many modern lacrosse sticks are made of metal alloys and plastic composites. They are lighter and more uniform than wood, but some of their properties, such as vibration damping, impact absorption, strength, and balance, are not are good as players desire. As a result, they produce unwanted vibration, transfer impact shock to the user, and may break, leaving jagged ends that may injure themselves and other players.

BRIEF SUMMARY OF THE INVENTION

We have invented a stick for use in playing various sports that overcomes many of the deficiencies of prior sticks. The stick comprises a shaft to which various pieces of athletic equipment can be attached. It has a skin of hard composite resin over a soft foamed plastic core encasing a stiffener. The unique construction of the stick reduces its weight, increases its safety, and improves its behavior when used in playing sports.

The foamed plastic absorbs shocks and the skin and stiffener provide additional rigidity to the stick. By using a hollow tube as a stiffener, a fixed or moveable weight may be positioned within the hollow tube to enable the user to increase or decrease the weight and/or its position along the tube. A mounting plate at the end of the shaft is provided so that various types of athletic equipment may be attached to the end of the shaft.

The shaft of this invention is significantly more flexible shaft than the widely available commercial hollow metal or composite tube designs, and the increased flexibility improves safety for the players. For example when a player knocked to the ground has one end of a stick supported by his body with the other end on the ground, and another player falls on the stick, both players benefit from the diminished force applied to their bodies by the more flexible stick.

When a stick is stressed to breaking failure, it is desirable to have the failure point not present sharp edges capable of cutting a player. The composite stick of this invention minimizes sharp jagged edges and, when bent to the point of breaking, the skin collapses while the supporting core safely compresses. Commercial hollow metal and composite tube sticks, on the other hand, present sharp points at each side of the fold when bent to folding and, in the case of strong alloys, metal spall has occurred. In one case, a 3/16-inch by ½-inch long piece was forcefully ejected from the surface, hitting the test engineer's face shield. Since players do not generally wear eye protection spall could present an eye damage hazard.

During lacrosse play, stick-on-stick impact is common, which shocks the hands of the players. Repetitive shocking can lead to injury. The sticks of this invention dampen the shock much more than the commercial hollow tube designs.

Other objects, features, and advantages of the present invention will become apparent upon consideration of the following detailed description and the accompanying drawings, in which like reference designations represent like features throughout the figures.

DETAILED DESCRIPTION OF THE INVENTION

Figure 1:
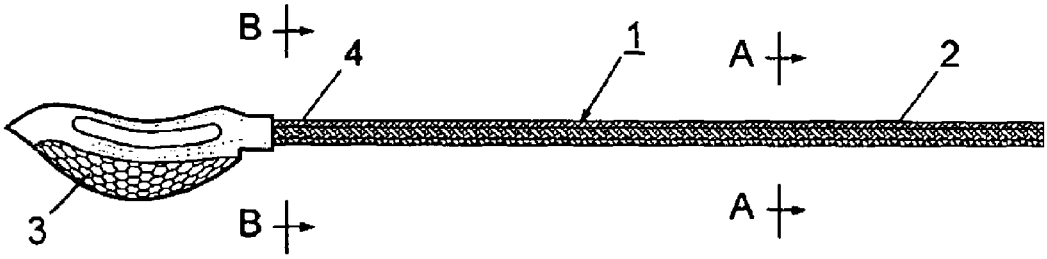
FIG. 1 is a side view of an embodiment of a lacrosse stick according to this invention that has a spar-stiffened shaft.

In FIG. 1, lacrosse stick 1 comprises elongated shaft 2 with lacrosse head frame and net 3 attached at one end 4. In addition to lacrosse head frame and net 3, other types of athletic equipment may be attached to shaft 2. For example, shaft 2 may be attached to a hockey blade, a tennis head frame and net, a golf club head, or no attachment in the case of a martial arts bo staff.

Shaft 2 may have any length that is appropriate for the sport and player size for which it is intended to be used. For example, for lacrosse, the shaft is preferably about 25 to about 60 inches long, for hockey it is preferably about 46 to about 62 inches long, for golf it is preferably about 20 to about 46 inches long, and for martial arts it is preferably about 30 to about 85 inches long. Shaft 2 is normally linear, but may be curved if desired.

Figure 2:
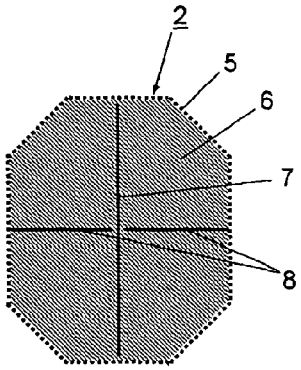
FIG. 2 is a view through A-A in FIG. 1.
Figure 3:
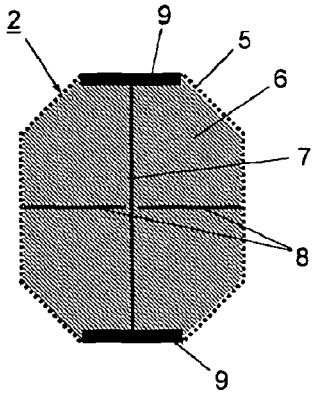
FIG. 3 is a view through B-B in FIG. 1.

In cross-section (FIGS. 2 and 3), shaft 2 may have any shape, including circular, oval, elliptical, polygonal, and other shapes, but an octagonal shape is preferred as it is usually easier for a human hand to grasp. To enable a player to feel the orientation of the shaft, the octagon preferably has four pairs of opposing parallel sides, where there are two long opposing sides, two medium length opposing sides at 90 degrees to the two long opposing sides, and four short opposing sides in between the long and medium length opposing sides at between about 30 degrees and about 50 degrees to the other sides, as shown in FIGS. 2 and 3. Various sports organizations may dictate the dimensions and other specifications for stick 1.

Still referring to FIGS. 2 and 3, shaft 2 has a dense and durable fiber-reinforced plastic skin 5 encasing a less dense shock-absorbing core 6. Skin 5 provides impact resistance to blows from other sticks or objects as well as rigidity to the shaft. Skin 5 is a composite material made of a hard plastic in which are embedded reinforcing fibers. Examples of suitable reinforcing fibers include fiberglass, para-aramid polymer fibers, carbon fibers, and metal fibers; a hybrid weave of polyamide (para-aramid polymer) fibers and carbon fibers is preferred because of its combined high modulus and dynamic loading capabilities. The fibers are preferably in the form of a woven fabric to provide continuous reinforcement in two directions. Preferably, the directions are perpendicular and one is aligned with the longitudinal axis of the shaft. Examples of suitable polymer resins for the fiber-reinforced composite resin skin include: polyester, vinyl ester, polycarbonate, polyamide, polyethylene, polypropylene, and polyphenylene sulfide. The preferred resin is polyester because of its durability, impact strength, and ultraviolet (UV) resistance. Preferably, outer skin 5 is made of a hybrid woven fabric of carbon fiber and polyamide fiber (e.g., "Kevlar") melded in an epoxy polymer matrix resin. A coating of polyurethane or other non-slippery plastic (not shown) may be applied over skin 5 to dampen vibrations and provide a surface that is not slippery.

Core 6 is a light weight, shock-absorbing material. Examples of suitable materials include balsa wood and structural plastic foams, such as polyurethane, and polystyrene; the preferred core material is extruded polystyrene because it has a fine cell "grain" structure that runs vertically through the foam rather than horizontally or lengthwise like expanded polystyrene or polyurethane foam. The vertical cell alignment creates a rigid honeycomb effect ideal for high shear load and impact. The vertical cell structure also allows for better penetration of the epoxy resin into the foam's surface thereby enhancing the bond between the foam core 6 and the outer skin 5.

Core 6 has an elongated stiffening member or members encased within it. In FIGS. 2 and 3 the stiffening member is spar 7, which extends the length of shaft 2, but may terminate about 0 to about 3 inches from each end. A single spar 7 may be used or several spars 7 may be used in order to increase stiffness. Spar 7 preferably has vanes 8 that extend laterally in two perpendicular directions, as shown in FIGS. 2 and 3, but may extend laterally in only a single direction or in more than two directions, or in directions that are not perpendicular, if desired. Spar 7 is preferably orientated with its vanes 8 perpendicular to sides of shaft 2. Vanes 8 are preferably about 0.015 inches to about 0.060 inches thick and extend from the center of spar 7 about 0.25 inches to about 1 inch. Spar 7 may be made of various rigid materials, such as unidirectional carbon fiber, metal, or plastic, but it is preferably made of unidirectional carbon fiber because of its superior rigidity and strength to weight ratio.

Referring to FIG. 3, shaft 2 is also provided with at least one mounting plate 9 located at end 4 to which a lacrosse head frame and net 3 or other athletic equipment may be attached. Mounting plate 9 is preferably a lightweight, high-strength material. Metals, such as aluminum alloy, steel, titanium, etc., and other materials such as mineral glass filled nylon may be used. Mounting plate 9 is preferably permanently attached to shaft 2, but it may also be attached by means of a fastener, such as clips, screws, nuts and bolts, etc., so that it may be removed and replaced if it becomes damaged or worn.

Figure 4:
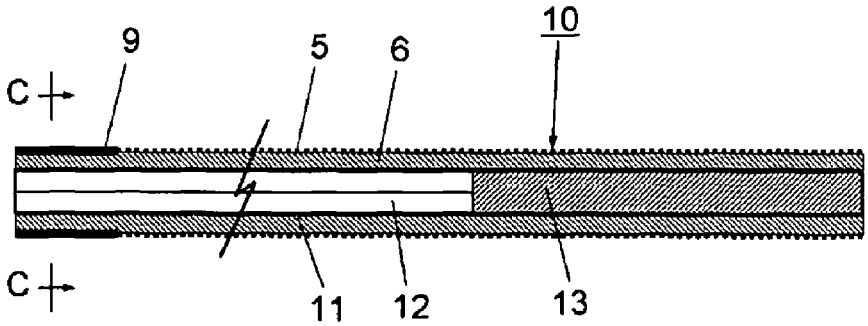
FIG. 4 is a side view in section of embodiment of a hollow tube stiffened shaft according to this invention.
Figure 5:
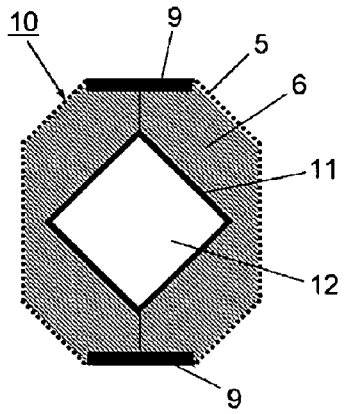
FIG. 5 is a view through C-C in FIG. 4.

In FIGS. 4 and 5, shaft 10 also has a skin 5, core 6, and mounting plate 9, but the elongated stiffening member is square hollow tube 11. Hollow tube 11 may be, in cross section, circular, oval, elliptical, rectangular, square, or other shape; preferably, it is square or rectangular. It may be made of various rigid materials, such as metals, fiberglass, graphite, carbon fiber, or plastic, but is preferably made of carbon fiber and has walls about 0.010 to about 0.060 inches thick.

Referring to FIG. 4, the inside of hollow tube 11 is empty space 12 at one end 4 and is a lightweight, shock-absorbing counterbalance material 13, such as core 6, at the other end.

Figure 7:
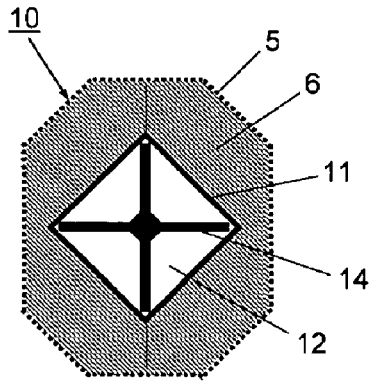
FIG. 7 is a view through D-D in FIG. 6.
Figure 6:
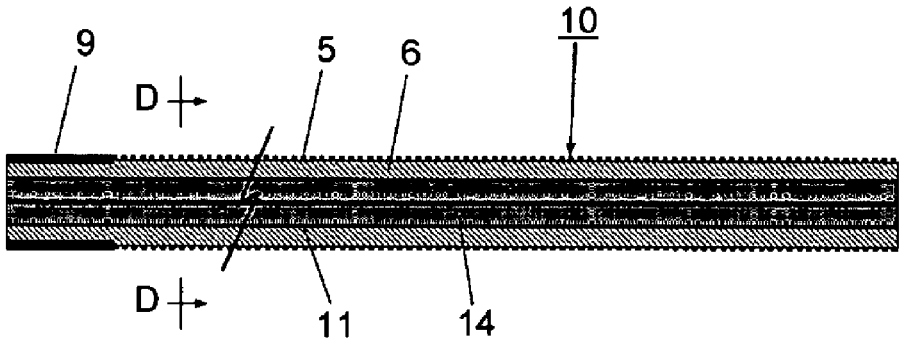
FIG. 6 is a side view in section of a shaft similar to the shaft of FIG. 4, where the hollow tube contains spars.

In FIGS. 6 and 7, shaft 10 has a skin 5, core 6, and mounting plate 9, inside the elongated stiffening member 11 is a composite structure 14 which consist of a "X" shaped stiffener, similar to spar 7.

Figure 8:
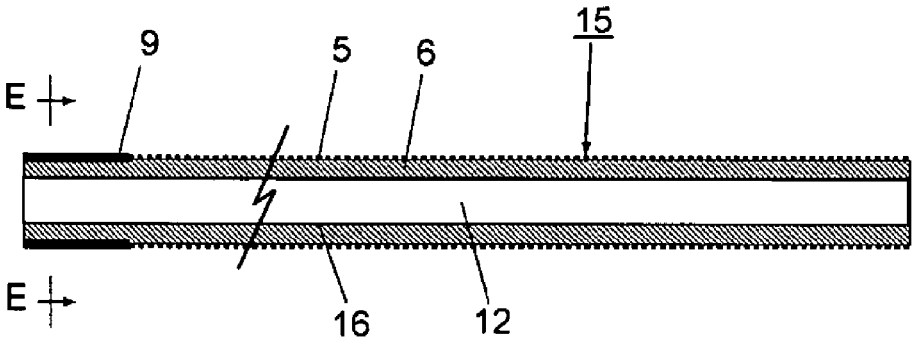
FIG. 8 is a side view in section of a shaft similar to the shaft of FIG. 4, where the internal stiffener is a round hollow tube.
Figure 9:
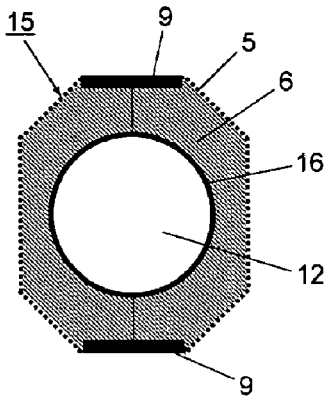
FIG. 9 is a view through E-E in FIG. 8.

In FIGS. 8 and 9, shaft 15 has a skin 5, core 6 and mounting plate 9, but the elongated stiffening member is a round hollow tube 16.

Figure 10:
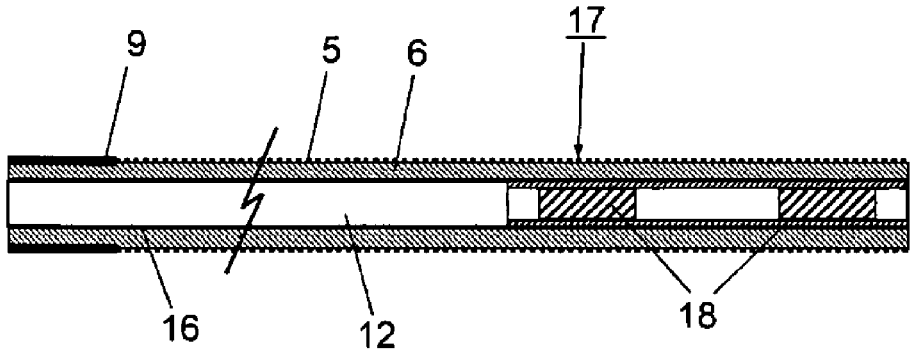
FIG. 10 is a side view in section of a shaft similar to the shaft of FIG. 8, where the hollow tube contains adjustable weights. The inside portion of tube that the weights are in contact with, is threaded, so that the user can turn the weights moving them in or out to adjust and set their fixed position. The end of the threaded weights are slotted or otherwise altered on the outside so that it can be turned by the user.

In FIG. 10, shaft 17 has a skin 5, core 6, mounting plate 9, and elongated stiffening member 16, contained within elongated stiffening member 16 are adjustable, threaded, counterbalance weights 18.

Figure 11:
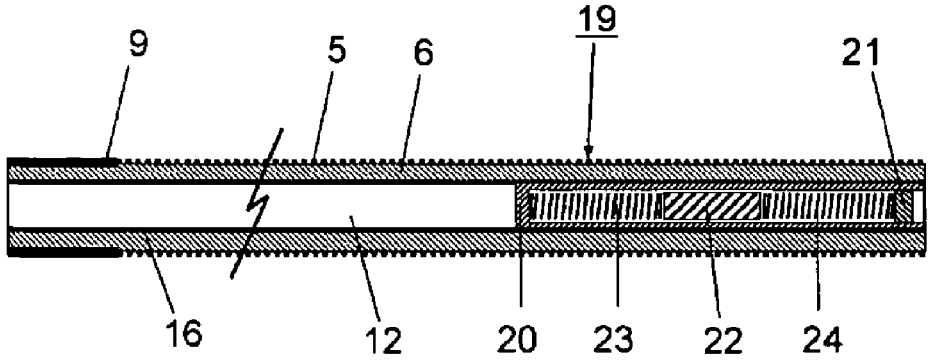
FIG. 11 is a side view in section of shaft similar to the shaft of FIG. 10, where the movement of the weight is opposed by springs.

Shaft 19, shown in FIG. 11, is similar to the shaft 17 of FIG. 10, but hollow tube 16 has a seal 20 at one end and a plug 21 at the other that is slotted on the outside (not shown). Inside tube 16 is weight 22 that slides within tube 16. A first spring 23 is in between weight 22 and seal 20 and a second spring 24 is in between weight 22 and plug 21. When shaft 19 is swung by the user, centrifugal force moves weight 22 opposite to end 4. When the swing is over, weight 22 returns its original rest position. Plug 21 is slotted or otherwise altered on the outside so that it can be turned by the user. The inside portion of tube 16 that plug 21 is in contact with is threaded so that the user can turn plug 21 to move it in or out and thereby increase or decrease the force of springs 23 and 24 on weight 22.

Figure 12:
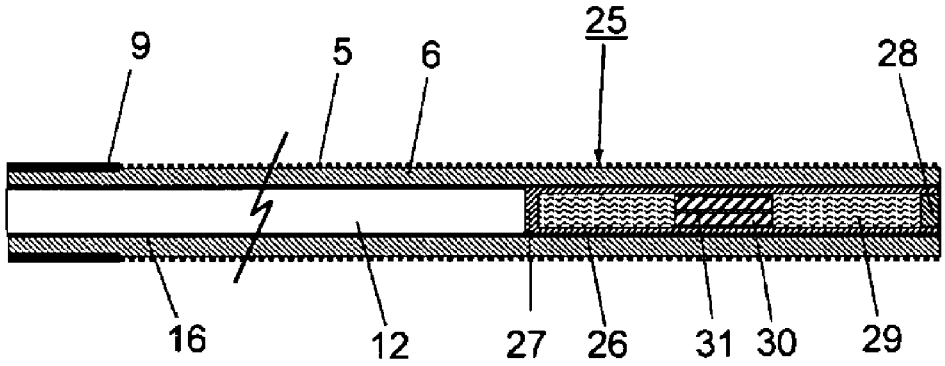
FIG. 12 is a side view in section of a shaft similar to the shaft of FIG. 10, where the movement of a weight in the hollow tube is dampened.

In FIG. 12, shaft 25 is similar to shaft 17, but has an internal hollow tube 26 (inside tube 16) with a seal 27 at one end and a plug 28 at the other. Tube 26 is filled with fluid 29 and contains weight 30 that has a passageway 31 through it. When the shaft is swung, centrifugal force moves weight 30, but fluid 29 dampens the movement. Fluid 29 is preferably a medium-viscosity, temperature-stable hydraulic dampening fluid such as motor oil, or vegetable oil. It counter balances the head and allows the player to angle the stick intentionally shifting the center of gravity providing a dynamic weighting.

Figure 13:
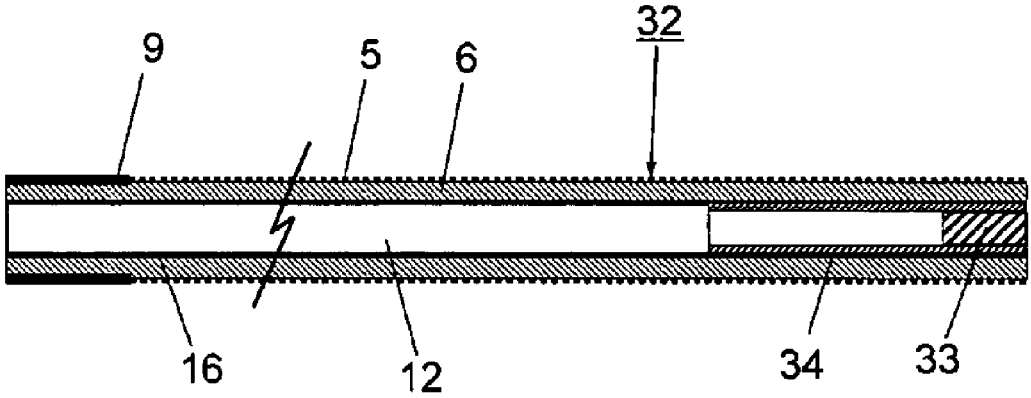
FIG. 13 is a side view of a shaft similar to the shaft of FIG. 10, where the position of the weight in the hollow tube is adjustable.

Shaft 32, in FIG. 13, is similar to shaft 17, but weight 33 has threads that engage the threaded inside of tube 34. Weight 33 is provided with, for example, a slot at the end (not shown) so that the user can adjust the position of the weight 33 along the inside of shaft 32 as well as removing or replacing the weight with a heavier or lighter weight, by turning weight 33 with a screwdriver.

Figure 14:
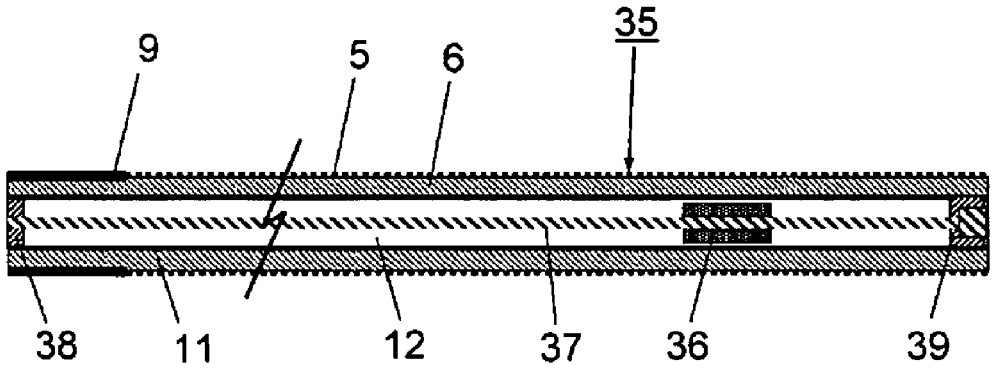
FIG. 14 is a side view of a shaft similar to the shaft of FIG. 10, where the weight is on a screw drive and its position is adjustable.

Shaft 35, in FIG. 14, is similar to shaft 9, with a skin 5, core 6, mounting plate 9, and an internal hollow tube 11. Inside tube 11 is weight 36, which threadedly engages screw drive 37. Screw drive 37 is rotatably attached to block 38 at one end and to housing 39 at the other. Screw drive 37 is provided with, for example, a slot (not shown) at the end held by housing 39 so that the user can turn it with a screwdriver, thereby moving weight 36 along the inside of tube 11.

The shafts of this invention may be made by a variety of processes that will be apparent to those skilled in the art. In one process, a foamed core stock is made by injection molding in two longitudinal halves that are partially hollowed out. The various internal parts are then inserted into one of the halves, the two halves are glued together, and the skin is applied over them. Before the skin is applied, internal spaces can be injected with foamed plastic.

A first flow, flow A below, is an example of a process for making an athletic shaft of the invention.

| Flow A | | |
|---|---|---|
| Step 1 | Produce the Inner Core (6) | Starting with rectangular stock of desired material, such as structural foam or balsa wood (6), machine to proper external octagonal dimensions in accordance with NCAA and other governing organization's regulations and industry standards, and shape core (2) being careful to manage thickness to accommodate future manufacturing steps. |
| Step 2 | Inner Core Minor Axis Lamination (8) | Split the shaped core by saw to appropriately insert and epoxy/adhesive-in-place a laminate layer (8) of structural composite material, such as unidirectional carbon fiber. Clamp the laminated structure appropriately and allow to set. |
| Step 3 | Inner Core Major Axis Lamination (7) | Vertically split the horizontally laminated shaped core by saw, bisecting the step 2 laminate layer (8), enabling the stick to be laminated in quarters when viewed as a cross section. Now insert and epoxy/adhesive-in-place a laminate layer (7) of structural composite material, such as unidirectional carbon fiber. Clamp the laminated structure appropriately and allow to set. |
| Step 4 | Inserting Head Mounting Tabs (9) | Carefully notch the head-end (4) of the inner core (6) to receive head-mounting screw reinforcement plates. The plates (9) located as shown in FIG. 3 and similar to plates (9) in FIG. 4 Section C-C, should be flush with the inner core (6) surface. |
| Step 5 | Fabricating the Structural Outer Shell inner Layer (5) | Carefully slide the continuously woven, directionally oriented, composite sleeve of material (5) such as carbon/carbon or Kevlar/carbon, over the laminated shaped inner core (6). Imbed composite sleeve with desired multipart resin and place in two-part shaped mold and allow to cure. |
| Step 6 | Fabricating the Structural Outer Shell Outer Layer | Carefully slide another layer of continuously woven, directionally oriented, composite sleeve of material such as Kevlar/carbon, over the inner shell layer (5). Imbed composite sleeve with desired multipart resin and place in a two-part shaped mold and allow to cure. |
| Step 7 | Finish Coat | Apply product body graphics as desired, apply end stickers to seal and protect the core (6), then coat with a thin layer of polyurethane and allow to dry. |

A second flow, flow B below, is an example of a process for making an athletic shaft of the invention.

| Flow B | | |
|---|---|---|
| Step 1 | Produce the Inner Core (6) | Starting with rectangular stock of desired material, such as structural foam or balsa wood (6), machine to proper external octagonal dimensions in accordance with NCAA and other governing organization's regulations and industry standards, and shape core (2) being careful to manage thickness to accommodate future manufacturing steps. |

-continued

| Flow B | | |
|---|---|---|
| Step 2 | Inner Core Internal Member Lamination (11) | Split the shaped core by saw along the major axis to expose the inner surface of the two halves. With a shaped bit router, machine a shaped channel down the center of the length of each half to receive half of a structural component (11) of specific shape such as a round (16) or rectangular (11) or triangular shaped hollow tube or an extruded or formed hollow or solid shape of custom design of such material as unidirectional carbon fiber, metallic alloy, or other suitable material providing desired rigidity and strength. With epoxy or appropriate adhesive, laminate the internal structural component (11) and the two halves of the inner core material (6) all to each other. Clamp the laminated structure appropriately and allow to cure. |
| Step 3 | Inserting Head Mounting Tabs (9) | Carefully notch the head-end (4) of the inner core (6) to receive head-mounting screw reinforcement plates (9). The plates (9) located as shown in FIG. 5, should be flush with the inner core (6) external surface. |
| Step 4 | Fabricating the Structural Outer Shell Inner Layer (5) | Carefully slide the continuously woven, directionally oriented, composite sleeve of material (5) such as carbon/carbon or Kevlar/carbon, over the laminated inner core (6). Imbed composite sleeve with desired multipart resin and place in two-part shaped mold and allow to cure. |
| Step 5 | Fabricating the Structural Outer Shell Outer Layer | Carefully slide another layer of continuously woven, directionally oriented, composite sleeve of material such as Kevlar/carbon, over the first shell layer (5). Imbed composite sleeve with desired multipart resin and place in a two-part shaped mold and allow to cure. |
| Step 6 | Finish Coat | Apply product graphics as desired, apply end stickers to seal and protect the core (6), then coat with a thin layer of polyurethane and allow to dry. |

A third flow, flow C below, is an example of a process for making an athletic shaft of the invention.

| Flow C | | |
|---|---|---|
| Step 1 | Produce the Inner Core (6) | Starting with rectangular stock of desired material, such as structural foam or balsa wood (6), machine to proper external octagonal dimensions in accordance with NCAA and other governing organization's regulations and industry standards, and shape core (2) being careful to manage thickness to accommodate future manufacturing steps. |
| Step 2 | Inner Core Internal Member Lamination (11) | Split the shaped core by saw along the major axis to expose the inner surface of the two halves. With a shaped bit router, machine a shaped channel down the center of the length of each half to receive half of a structural component (11) of specific shape such as a round (16) or rectangular (11) or triangular shaped hollow tube or an extruded or formed hollow shape of custom design of such material as unidirectional carbon fiber, metallic alloy or other suitable material providing desired rigidity and strength. With epoxy or appropriate adhesive, laminate the internal structural component (11) and the two halves of the inner core material (6) all to each other. Clamp the laminated structure appropriately and allow to cure. |
| Step 3 | Adding Vibration Dampening Counter Balance Material (13) | Insert variable length vibration dampening counter balance material (13) to desired location toward the nonhead end (2) of the stick, inside the tube (11), completely filling or partially filling (13) the internal tube structure (12) inside the inner core (6) as shown in FIG. 4. The exact positioning of the counter balance material may vary in accordance with product specifications to yield different performance characteristics of different models being produced. |
| Step 4 | Inserting Head Mounting Tabs (9) | Carefully notch the head-end (4) of the inner core (6) to receive head-mounting screw reinforcement plates (9). The plates (9) located as shown in FIG. 5, should be flush with the inner core (6) external surface. |

-continued

| Flow C | | |
|---|---|---|
| Step 5 | Fabricating the Structural Outer Shell Inner Layer (5) | Carefully slide the continuously woven, directionally oriented, composite sleeve of material (5) such as carbon/carbon or Kevlar/carbon, over the laminated inner core (6). Imbed composite sleeve with desired multipart resin and place in two-part shaped mold and allow to cure. |
| Step 6 | Fabricating the Structural Outer Shell Outer Layer | Carefully slide another layer of continuously woven, directionally oriented, composite sleeve of material such as Kevlar/carbon, over the first shell layer (5). Imbed composite sleeve with desired multipart resin and place in a two-part shaped mold and allow to cure. |
| Step 7 | Finish Coat | Apply product graphics as desired, apply end stickers to seal and protect the core (6), then coat with a thin layer of polyurethane and allow to dry. |

A fourth flow, flow D below, is an example of a process for making an athletic shaft of the invention.

| Flow D | | |
|---|---|---|
| Step 1 | Produce the Inner Core (6) | Starting with rectangular stock of desired material, such as structural foam or balsa wood (6), machine to proper external octagonal dimensions in accordance with NCAA and other governing organization's regulations and industry standards, and shape core (2) being careful to manage thickness to accommodate future manufacturing steps. |
| Step 2 | Inner Core Internal Member Lamination (11) | Split the shaped core by saw along the major axis to expose the inner surface of the two halves (6). With a shaped bit router, machine a shaped channel down the center of the length of each half to receive half of a structural component (11) of specific shape such as a round (16) or rectangular (11) or triangular shaped hollow tube or an extruded or formed hollow shaped tube, with integrally formed internal supports of custom design of such material as unidirectional carbon fiber, metallic alloy or other suitable material providing desired rigidity and strength. With epoxy or appropriate adhesive, laminate the internal structural component (11) and the two halves of the inner core material (6) all to each other. Clamp the laminated structure appropriately and allow to cure. |
| Step 3 | Adding Variable Length Integrated Stiffening Member(s) (14) | Insert variable length integrated stiffening member (14) inside inner core (6) structural tube (11) to desired location as specified in product specifications to yield different performance characteristics of different models being produced, stiffening member (14) may run the entire length of the stick or only partially. Secure stiffening member in place with adhesive or other mechanical devise such as foam packing or oversized rubber plugs. |
| Step 4 | Inserting Head Mounting Tabs (9) | Carefully notch the head-end (4) of the inner core (6) to receive head-mounting screw reinforcement plates (9). The plates (9) located as shown in FIG. 5, should be flush with the inner core (6) external surface. |
| Step 5 | Fabricating the Structural Outer Shell Inner Layer (5) | Carefully slide the continuously woven, directionally oriented, composite sleeve of material (5) such as carbon/carbon or Kevlar/carbon, over the laminated inner core (6). Imbed composite sleeve with desired multipart resin and place in two-part shaped mold and allow to cure. |
| Step 6 | Fabricating the Structural Outer Shell Outer Layer | Carefully slide another layer of continuously woven, directionally oriented, composite sleeve of material such as Kevlar/carbon, over the first shell layer (5). Imbed composite sleeve with desired multipart resin and place in a two-part shaped mold and allow to cure. |
| Step 7 | Finish Coat | Apply product graphics as desired, apply end stickers to seal and protect the core (6), then coat with a thin layer of polyurethane and allow to dry. |

A fifth flow, flow E below, is an example of a process for making an athletic shaft of the invention.

| Flow E | | |
|---|---|---|
| Step 1 | Produce the Inner Core (6) | Starting with rectangular stock of desired material, such as structural foam or balsa wood (6), machine to proper external octagonal dimensions in accordance with NCAA and other governing organization's regulations and industry standards, and shape core (2) being careful to manage thickness to accommodate future manufacturing steps. |
| Step 2 | Inner Core Internal Member Lamination (11) | Split the shaped core by saw along the major axis to expose the inner surface of the two halves. With a shaped bit router, machine a shaped channel down the center of the length of each half to receive half of a structural component (11) of specific shape such as a round (16) or rectangular (11) or triangular shaped hollow tube or an extruded or formed hollow or solid shape of custom design of such material as unidirectional carbon fiber, metallic alloy or other suitable material providing desired rigidity and strength. With epoxy or appropriate adhesive, laminate the internal structural component (11) and the two halves of the inner core material all to each other. Clamp the laminated structure appropriately and allow to cure. |
| Step 3 | Adding Variable Length Adjustable Counter-balance Weighting System (17) | Insert variable length adjustable counter weight system housing in the nonhead end of the stick (FIG. 10), permanently secure with adhesive inside the tube (11, 16) inside the inner core (6) positioned as shown in FIG. 10. The inner core adjustable counter weights (18) are supplied with the stick and installed by the end user by screwing the weights into the inner core adjustable counter weight system housing, weights (18) may be installed in the end or deeper internally to desired locations to yield preferred balance and feel. The length of the counter weight system housing may vary as specified in product specifications to yield different performance characteristics of different models being produced. |
| Step 4 | Inserting Head Mounting Tabs (9) | Carefully notch the head-end (4) of the inner core (6) to receive head-mounting screw reinforcement plates (9). The plates (9) located as shown in FIG. 5, should be flush with the inner core (6) external surface. |
| Step 5 | Fabricating the Structural Outer Shell Inner Layer (5) | Carefully slide the continuously woven, directionally oriented, composite sleeve of material (5) such as carbon/carbon or Kevlar/carbon, over the laminated inner core (6). Imbed composite sleeve with desired multipart resin and place in two-part shaped mold and allow to cure. |
| Step 6 | Fabricating the Structural Outer Shell Outer Layer | Carefully slide another layer of continuously woven, directionally oriented, composite sleeve of material such as Kevlar/carbon, over the first shell layer (5). Imbed composite sleeve with desired multipart resin and place in a two-part shaped mold and allow to cure. |
| Step 7 | Finish Coat | Apply product graphics as desired, apply end stickers to seal and protect the core (6), then coat with a thin layer of polyurethane and allow to dry. |

In addition to the implementation of shafts discussed above, other implementations can combine elements from each of the following categories:

Outer Shell: Various embodiments of the invention further include: a composite outer shell (5) with diagonally oriented or regularly (nondiagonally) oriented continuous weave fabric of single or multiple materials. The invention further comprising: a composite outer shell (5) with multiple layers of diagonally oriented and/or regularly (nondiagonally) oriented continuous weave fabric each of single or multiple materials, or combinations of these.

Core: The invention further comprising: a solid inner core of laminated layers of core material (6) and carbon fiber strips (7, 8).

The invention further comprising: a solid inner core of laminated layers of core material (6) and custom shaped hollow tubing (11, 16). The invention further comprising: a solid inner core of laminated layers of core material (6) and custom shaped, partially hollow, tubing (11, 16).

The invention further comprising: a solid inner core of laminated layers of core material (6) and custom shaped filled tubing (11, 16). The invention further comprising: a solid inner core of laminated layers of core material (6) and custom shaped internal member.

EXAMPLES

Part I

Shafts of this Invention

The shafts tested in the examples had a cross-section and size similar to the commercial hollow tube designs, that is, they had a slightly elongated octagon geometry. The shaft design combined a thin outer composite skin (hybrid fabric melded in a polymer matrix resin) over a shock absorbing core with a laminated inner stiffening element. Both the skin and core elements were combined in various configurations to produce specific mechanical behavior profiles.

Three multilayered skin configurations were tested to determine the contributions of the skin and core to performance. The first multilayer composite skin had an inner layer of Kevlar (a para-aramid polymer fiber, long-chain synthetic polyamide sold by Dupont)/carbon hybrid fabric and an outer layer of Kevlar/carbon hybrid fabric. The second had an inner layer of Kevlar/carbon hybrid fabric and an outer layer of carbon/carbon fabric. The third had an inner layer of carbon/carbon fabric and an outer layer of carbon/carbon fabric.

Ten different material combinations were tested to determine how the shaft bending flexibility and breaking point could be altered and controlled. All ten specimens were 31 inches in length. There were four complex shaft cores without the outer skin, four complex shaft cores with Kevlar/carbon-Kevlar/carbon composite skins, and two with simple balsa cores (one with a Kevlar/carbon-carbon/carbon composite skin and the other with a carbon/carbon-carbon/carbon composite skin). Table 1 describes the test specimens.

TABLE 1

| Specimen | Weight (oz) | Type of core | Skin |
|---|---|---|---|
| A1 | 4.4 | 0.060-in spar in balsa | None |
| A2 | 2.7 | 0.030-in spar in balsa | None |
| A3 | 2.6 | Round graphite tube in balsa | None |
| A4 | 3.4 | Square aluminum tube in balsa | None |
| A5 | 7.2 | 0.060-in spar in balsa | Kevlar/carbon-Kevlar/carbon |
| A6 | 6.0 | 0.030-in spar in balsa | Kevlar/carbon-Kevlar/carbon |
| A7 | 6.1 | Round graphite tube in balsa | Kevlar/carbon-Kevlar/carbon |
| A8 | 6.1 | Square aluminum tube in balsa | Kevlar/carbon-Kevlar/carbon |
| A9 | 4.1 | Balsa core no stiffener | Kevlar/carbon-carbon/carbon |
| A10 | 4.4 | Balsa core no stiffener | Carbon/carbon-carbon/carbon |

The spar configurations (A1, A2, A5, and A6) had unidirectional carbon fiber spar stiffeners running the length of the shaft. In cross-section, the carbon-carbon spar appears as an "X" that is 0.06 or 0.03 inches thick; it was oriented so as to bisect the balsa across both minor axes of the shaft. The round graphite tubes (A3 and A7) had an outside diameter of 0.5 inches with a wall thickness of 1/16 inch; the tube ran the length of the balsa core centered on the major and minor axes of the shaft. The square aluminum tubes (A4 and A8) were square tubes with an outside length on a side of 3/8 inches and a wall thickness of 1/32 inches; the tube ran the length of the balsa core centered on the major and minor axes of the shaft. The orientation of the tube was aligned with the tube corners in line with the major and minor axes of the shaft. The balsa cores (A9 and A10) were solid pieces of balsa that ran the length of the stick. The Kevlar/carbon-carbon/carbon skin and the carbon/carbon-carbon/carbon skin had a thickness of approximately 0.030 inches.

Example 1

Bending Tests

Bending load testing determined the stress-to-strain measurement under bending and the failure stress, the point of permanent deformation. Additional force was then applied to produce catastrophic failure, or collapse. Measurements were made using a Strike Bender Test Method (SBTM) Machine. This test also measured the elastic stress-strain rate of the shaft that would result from in a Lacrosse ball throwing (shooting) maneuver.

Using the SBTM, bending stress-strain was determined by mounting a shaft in the hard point bending mounts on a SBTM machine and applying a force perpendicular to the head mounting end. The shafts were mounted to bend across the shorter of the two axes. Force and deflection were measured continuously with incremental increases in the force to establish the stress-strain response until permanent deformation was observed. Upon observing permanent deformation, force was applied to produce catastrophic failure. The results are shown in table 2, where "( )" indicates plastic deformation (elastic limit), "[ ]" indicates structural failure, "{ }" indicates collapse, and an underline indicates spalling.

The balsa core alone and skin alone individually had strengths so low they were not measurable using the SBTM machine and therefore they are not included in the test results. The core by itself had a measurable strength, but in the skin and core combination, the strength can be 2 to 5 times greater than the core alone.

TABLE 2

Bending Test—Shafts of this Invention

| | | lbs | | | | | | | | | |
|---|---|---|---|---|---|---|---|---|---|---|---|
| cm | in | A5 | A1 | A6 | A2 | A7 | A3 | A8 | A4 | A9 | A10 |
| 1 | 0.4 | 4 | | 2 | 1 | 4 | 2 | 0 | 1 | 1 | 2 |
| 2 | 0.8 | 9 | 7 | 4 | 0 | 9 | 4 | 4 | 2 | 4 | 5 |
| 3 | 1.2 | 14 | 11 | 8 | 2 | 14 | 7 | 6 | 4 | 5 | 7 |
| 4 | 1.6 | 19 | 15 | 11 | 0 | 17 | 8 | 6 | 6 | 7 | 9 |

TABLE 2-continued

| Bending Test—Shafts of this Invention | | | | | | | | | | | |
|---|---|---|---|---|---|---|---|---|---|---|---|
| | | lbs | | | | | | | | | |
| cm | in | A5 | A1 | A6 | A2 | A7 | A3 | A8 | A4 | A9 | A10 |
| 5 | 2.0 | 24 | 18 | 13 | 0 | 23 | 11 | 11 | 6 | 9 | 11 |
| 6 | 2.4 | 28 | (19) | 13 | 0 | 27 | 16 | 13 | 8 | 11 | 12 |
| 7 | 2.8 | 33 | 20 | 15 | [7] | 31 | 17 | 15 | 9 | 12 | 14 |
| 8 | 3.1 | 38 | 22 | 25 | | 35 | 20 | 17 | 10 | 14 | 16 |
| 9 | 3.5 | 43 | 24 | 28 | 0 | 38 | 23 | 19 | 11 | 14 | 17 |
| 10 | 3.9 | (45) | 27 | 31 | 0 | 41 | 25 | 20 | 12 | 16 | [20] |
| 11 | 4.3 | 51 | 28 | 31 | | 44 | [26] | (22) | [10] | 17 | 21 |
| 12 | 4.7 | 55 | 29 | 34 | | 48 | {26} | 22 | 11 | 19 | 22 |
| 13 | 5.1 | 60 | {30} | 36 | | [50] | | 24 | 11 | 20 | 22 |
| 14 | 5.5 | 66 | | 39 | | {58} | | 24 | 11 | [19] | 24 |
| 15 | 5.9 | 70 | | [32] | {13} | | | 26 | {11} | 20 | 24 |
| 16 | 6.3 | 77 | | 34 | | | | 26 | | | 26 |
| 17 | 6.7 | [81] | | 35 | | | | 28 | | 21 | 26 |
| 18 | 7.1 | 86 | | {35} | | | | [28] | | 22 | 26 |
| 19 | 7.5 | 53 | | | | | | | | 21 | 26 |
| 20 | 7.9 | 62 | | | | | | | | 21 | 26 |
| 21 | 8.3 | {65} | | | | | | 27 | | 21 | 26 |
| 22 | 8.7 | | | | | | | {27} | | 21 | 27 |
| 23 | 9.1 | | | | | | | | | {21} | 26 |
| 24 | 9.4 | | | | | | | | | | {26} |
| 25 | 9.8 | | | | | | | | | | |

The stronger shaft in A5 exhibited no plastic deformation until it had been bent through 3.9 inches at 45 pounds of force. In A8, the square aluminum core stiffener had plastic deformation at 13-pound force and 2.4 in deflection. Thus, the point of plastic deformation ranged from 2.4 inches to 3.9, a factor of 1.6.

Example 2

Stress-Strain

Using the data given in table 2, the stress-strain, the stress at plastic deformation, and the elastic linear stress-strain rate were calculated. Table 3 gives the results.

TABLE 3

| Test Elastic Stress and Strain | | | | |
|---|---|---|---|---|
| Specimen | Core-skin | Stress (lbs) | Strain (in) | Elastic Stress/ Strain Rate (lbs/in) |
| A1 | 0.060-in spar in balsa-no skin | 18 | 2.0 | 9 |
| A2 | 0.030-in spar in balsa-no skin | 7.1 | 2.8 | 2.5 |
| A3 | Round graphite tube in balsa-no skin | 16 | 2.4 | 6.7 |
| A4 | Square aluminum tube in balsa-no skin | 6 | 2.0 | 3 |
| A5 | 0.060-in spar in balsa-Kevlar/carbon-Kevlar/carbon | 33 | 2.8 | 11.8 |
| A6 | 0.030-in spar in balsa-Kevlar/carbon-Kevlar/carbon | 31 | 5.1 | 6.1 |
| A7 | Round graphite tube in balsa-Kevlar/carbon-Kevlar/carbon | 38 | 3.5 | 11 |
| A8 | Square aluminum tube in balsa-Kevlar/carbon-Kevlar/carbon | 17 | 3.1 | 5.5 |
| A9 | Balsa-Kevlar/carbon-carbon/carbon | 14 | 3.5 | 4 |
| A10 | Balsa-carbon/carbon-carbon/carbon | 12 | 2.4 | 5 |

The various cores with skin had a significant increase in bending strength over cores without skin. Adding a core stiffening element (A8) to the simple balsa core (A9) increased the bending stress-strain rate from 4 to 5.5, a factor of 1.37 and, by selecting a more efficient core stiffening element, the factor was increased to 3 (A5 compared to A9 is 11.8/4=2.95). By changing the core stiffeners, as was done A5, A6, A7, and A8, the bending stress-strain rates varied by a factor of 2, (11.8/5.5=2.1).

In the weakest of the sticks of this invention, A8, the square aluminum core stiffener had a plastic deformation at 22 pounds force and 4.3 in deflection. The remainder of the shafts of this invention exhibited no plastic deformation up to structural failure. Thus, the point of plastic deformation and the structural failure point can be engineered by altering the core stiffener component.

In the case of the two balsa cores without the core stiffening elements (A9 and A10) there was a (5/4=1.25) a 25 percent difference in the bending stress-strain rate between the same core and two different skins. However, the balsa-carbon/carbon-carbon/carbon composite shaft (A10) weighed 0.3 ounces more than the balsa-Kevlar/carbon-carbon/carbon shaft (A9). Subtracting the weight of the balsa (1 ounce) from each of the shaft weights and taking the ratio of the skin weights, the carbon/carbon-carbon/carbon skin (A10) was 3.4/3.1=1.097 or 9.7 percent heavier. If the balsa core in each test is providing the same stiffness, then adjusting the total shaft stress-strain rate ratio to have the same skin weights, i.e. 1.25 times 3.1/3.4=1.14, the shaft with the carbon/carbon-carbon/carbon skin (A10) was 14 percent stronger than the Kevlar/carbon-carbon/carbon skin (A9).

TABLE 4

| Skin minus no skin | | | |
|---|---|---|---|
| Specimens | Core | Skin/no skin elastic stress-strain rate | Skin minus no skin elastic stress-strain rate (lb/in) |
| A5/A1 | 0.060-in spar in balsa | 11.8/9 = 1.3 | 11.8-9 = 2.8 lb/in |
| A6/A2 | 0.030-in spar in balsa | 6.1/2.5 = 2.4 | 6.1-2.4 = 3.7 |
| A7/A3 | Round graphite tube in balsa | 11/6.7 = 1.7 | 11-6.7 = 4.3 |
| A8/A4 | Square aluminum tube in balsa | 5.5/3 = 1.8 | 5.5-3 = 2.5 |
| Average | | 1.8 | 3.3 lb/in |

Adding the skin increased the stress-strain rate (stiffness) for each of the cores on average by 3.3 pounds per inch.

TABLE 5

Increase in bending stress-strain

| Specimens | Core | Skin Increases bending stress-strain rate by |
|---|---|---|
| A5/A1 | 0.060 in spar in balsa | 11.8/9 = 1.3 |
| A6/A2 | 0.030 in spar in balsa | 6.1/2.5 = 2.4 |
| A7/A3 | Round graphite tube in balsa | 11/6.7 = 1.7 |
| A8/A4 | Square Aluminum tube in balsa | 5.5/3 = 1.8 |
| | Average | 1.8 |

There was a significant increase in bending strength for the cores with skin over the cores without skin. On average, adding the skin increased the bending stress-strain rate by a factor of 1.8 for the skin thickness and cores tested.

Example 3

Structure Failure

Using the data in table 3, table 6 gives the point of structural failure. The test specimens broke without producing sharp jagged edges at the point of failure.

TABLE 6

Structural Failure

| Specimen | Type of core-skin | Structural point failure lbs | Structural point failure in | Stress-strain ratio (lb/in) |
|---|---|---|---|---|
| A5 | 0.060-in spar in balsa-Kevlar/carbon-Kevlar/carbon | 81 | 6.7 | 12 |
| A6 | 0.030-in spar in balsa-Kevlar/carbon-Kevlar/carbon | 32 | 5.9 | 5.4 |
| A7 | Round graphite tube in balsa-Kevlar/carbon-Kevlar/carbon | 50 | 5.1 | 9.8 |
| A8 | Square aluminum tube in balsa-Kevlar/carbon-Kevlar/carbon | 28 | 7.1 | 3.9 |

The core stiffener design affects the amount of force needed to cause structural failure. For the shafts of this invention tested in this program, there was almost a factor of three, from 3.9 to 12 pounds per inch, difference in the bending stress-strain rate at structural failure.

Example 4

Impact Vibration Tests

The impact/vibration test measured the vibration retention in the stick shaft after an impact.

Vibration damping was measured on the SBTM machine. A lacrosse stick was mounted in the machine and a speed controlled striking tube impacted a mounted lacrosse stick 3 inches from the "head end" and 15 inches from the nearest of two mount points. For the vibration test the standard impact was provided by adjusting the striker bar end velocity to 30 miles per hour. This simulated the stick velocity achieved when a lacrosse ball is passed from one player to another during play. The mounting of the test fixture is the same for each stick and was achieved by a nonadjustable latching mount. Acoustical vibrations were measured midway between the two mounting points which were positioned 10 inches apart to simulate a player's grip.

An integral of frequency and amplitude over time called the Total Power Measurement is the result of the strike energy. This is extracted from the measurement data using the Spectra Plus analyzer "total power utility." The Total Power (-dB) is used to verify that the impact on each test specimen was consistently applied so that other presentations of the recorded acoustic measurement can be directly compared.

TABLE 7

Integrated Vibration Energy

| Specimen | Type of core-skin | Total Power (dB) |
|---|---|---|
| A5 | 0.060-in spar in balsa-Kevlar/carbon-Kevlar/carbon | 59.8 |
| A6 | 0.030-in spar in balsa-Kevlar/carbon-Kevlar/carbon | 64.2 |
| A7 | Round graphite tube in balsa-Kevlar-carbon-Kevlar/carbon | 61.1 |
| A8 | Square Aluminum tube in balsa-Kevlar-carbon-Kevlar/carbon | 69 |
| A9 | Balsa core-Kevlar/carbon-carbon/carbon | 74 |
| | Average Total Power | 65.6 |

In Table 7 the similarity in total power shows the impact energy delivered to the sticks by the striker bar was comparable.

Example 5

Decay Time

Table 8 lists the decay time. That is the time from the impact sharp rise until the vibrations decay to the background noise level.

TABLE 8

Vibration Energy Decay Time

| Specimen | Type of core-skin | Decay Time (sec) |
|---|---|---|
| A5 | 0.060-in spar in balsa-Kevlar/carbon-Kevlar/carbon | 0.037 |
| A6 | 0.030-in spar in balsa-Kevlar/carbon-Kevlar/carbon | 0.031 |
| A7 | Round graphite tube in balsa-Kevlar-carbon-Kevlar/carbon | 0.037 |
| A8 | Square Aluminum tube in balsa-Kevlar/carbon-Kevlar/carbon | 0.036 |
| | Average | 0.035 |
| A9 | Balsa core-Kevlar/carbon-carbon/carbon | 0.031 |

The shortest decay time was for A9. Because A6 had the same decay time, 0.031 seconds, as A9, it indicates that a spar that thin does not retain vibrational energy.

The shortest decay time with a shaft of this invention was with a balsa core and no core stiffening element (A9). The thin 0.03-inch spar (A6) had the same decay time, 0.031 seconds, as the specimen with no core stiffening element (A9), indicating that a thin spar does not retain vibrational energy. The average decay time for the shafts of this invention that had core stiffeners was 0.035.

Part II

Comparison with Commercial Shafts

Example 6

Commercial Shafts—Bending Test

A set of commercial hollow tube shafts were selected for testing that were representative of those sold by several major sports equipment manufacturers. These shafts had a shaft cross-section that was a slightly elongated octagonal geometry. Table 9 describes the shafts.

TABLE 9

Commercial Test Specimens

| Specimen | Length (in) | Weight (oz) | Material | Manufacturer | Model |
|---|---|---|---|---|---|
| Hollow Metal Tubes | | | | | |
| C-1 | 30.5 | 8.6 | Alloy | STX | Titanium |
| C-2 | 30.5 | 7.2 | Alloy | Brine | Swizzle |
| C-3 | 30.25 | 6.5 | Alloy | Warrior | Levitathon |
| C-4 | 31 | 5.6 | Alloy | STX | SC + TI |
| C-5 | 31 | 5.3 | Alloy | STX | Scandium |
| C-6 | 31 | 5.8 | Alloy | STX | C405 |
| C-7 | 30 | 6.1 | Alloy | Warrior | Kryptolyte |
| C-8 | 31 | 6.1 | Alloy | STX | Steel 7000 |
| C-9 | 30.5 | 5.7 | Alloy | Brine | Supra 7075 |
| C-10 | 31 | 6.2 | Alloy | Warrior | Alloy 2000 |
| Split Shaft (Hybrid) | | | | | |
| C-11 | 30 | 7.1 | Alloy-composite | Warrior | Split shaft |
| Composite Hollow Tube | | | | | |
| C-12 | 30 | 7.1 | Composite | Brine | Python |
| C-13 | 30.25 | 5.7 | Composite | Brine | Composite |

The same tests that were performed in the preceding examples were performed on the commercial hollow alloy tube shafts. The results are given in Table 10.

TABLE 10

Bending Test—Hollow Tube Commercial Shafts

| | | lbs | | | | | | | | | |
|---|---|---|---|---|---|---|---|---|---|---|---|
| cm | in | C1 | C5 | C2 | C6 | C3 | C7 | C4 | C8 | C9 | C10 |
| 1 | 0.4 | 10 | 7 | 10 | 9 | 5 | 5 | 8 | 7 | 7 | 4 |
| 2 | 0.8 | 22 | 16 | 18 | 16 | 13 | 16 | 17 | 15 | 15 | 8 |
| 3 | 1.2 | (35) | 26 | 27 | 26 | 21 | 25 | 26 | 25 | 23 | 18 |
| 4 | 1.6 | 46 | 36 | (36) | 36 | | 35 | 35 | (36) | (33) | 30 |
| 5 | 2.0 | 60 | (46) | 45 | 46 | | 44 | (50) | 42 | [41] | (39) |
| 6 | 2.4 | 71 | 57 | 56 | 55 | | 49 | 62 | 50 | 44 | 51 |
| 7 | 2.8 | 82 | 66 | 61 | 64 | 29 | 60 | 70 | [58] | 47 | [61] |
| 8 | 3.1 | 94 | 72 | 68 | 76 | 64 | 68 | 81 | 62 | 50 | 60 |
| 9 | 3.5 | 105 | 78 | 79 | (84) | (70) | (79) | [94] | {62} | 49 | 62 |
| 10 | 3.9 | 114 | 83 | 83 | 90 | [78] | 86 | 99 | | 48 | {58} |
| 11 | 4.3 | 127 | [93] | 89 | [98] | {81} | [94] | 100 | | 48 | 60 |
| 12 | 4.7 | 140 | 97 | 96 | 100 | 77 | 95 | 98 | | {49} | 60 |
| 13 | 5.1 | [151] | 99 | [100] | {100} | 76 | {100} | {103} | | 47 | |
| 14 | 5.5 | 154 | 102 | 107 | 72 | 51 | 99 | 98 | | 43 | |
| 15 | 5.9 | 154 | {110} | 111 | 63 | 36 | 99 | | | 40 | |
| 16 | 6.3 | 168 | 106 | {115} | 51 | 29 | 74 | 67 | | 39 | |
| 17 | 6.7 | {153} | 65 | 94 | 38 | | 64 | 60 | | | |
| 18 | 7.1 | 148 | | 79 | | | 60 | 56 | | | |
| 19 | 7.5 | 82 | | 57 | | | 55 | 54 | | | |
| 20 | 7.9 | | | 41 | | | | | | | |
| 21 | 8.3 | | | | | | | | | | |

Table 11 compares the bending test results with the results for the shafts of this invention.

TABLE 11

Bending Test—Comparison of Composite Shafts

| | | lbs | | | | | | |
|---|---|---|---|---|---|---|---|---|
| Cm | in | C11 | C12 | C13 | A5 | A6 | A7 | A8 |
| 1 | 0.4 | 8 | 4 | 7 | 4 | 2 | 4 | 0 |
| 2 | 0.8 | 19 | 9 | 14 | 9 | 4 | 9 | 4 |
| 3 | 1.2 | 31 | 14 | 23 | 14 | 8 | 14 | 6 |
| 4 | 1.6 | 48 | 19 | 32 | 19 | 11 | 17 | 6 |
| 5 | 2.0 | 59 | 23 | 43 | 24 | 13 | 23 | 11 |
| 6 | 2.4 | (70) | 25 | 52 | 28 | 13 | 27 | 13 |
| 7 | 2.8 | 83 | 29 | 61 | 33 | 15 | 31 | 15 |
| 8 | 3.1 | 95 | 34 | 75 | 38 | 25 | 35 | 17 |
| 9 | 3.5 | 109 | 39 | 78 | 43 | 28 | 38 | 18 |
| 10 | 3.9 | [124] | 46 | {85} | 45 | 31 | 41 | 20 |
| 11 | 4.3 | 132 | 52 | | 51 | 31 | 44 | 22 |
| 12 | 4.7 | [138] | 57 | | 55 | 34 | 48 | (22) |
| 13 | 5.1 | | 62 | | 60 | 36 | [50] | 24 |
| 14 | 5.5 | | {68} | | 66 | 39 | {58} | 24 |
| 15 | 5.9 | | | | 70 | [32] | | 26 |
| 16 | 6.3 | | | | 77 | 34 | | 26 |
| 17 | 6.7 | | | | [81] | 35 | | 28 |
| 18 | 7.1 | | | | 86 | {35} | | [28] |
| 19 | 7.5 | | | | 53 | | | |
| 20 | 7.9 | | | | 62 | | | |
| 21 | 8.3 | | | | {65} | | | 27 |
| 22 | | | | | | | | {27} |
| 23 | | | | | | | | |

Example 7

Commercial Shafts, Stress-Strain Test

TABLE 12

Hollow Tube Test Elastic Stress-Strain Rates

| Specimen | Stress (lb) | Deformation deflection (in) | Stress/strain (lb/in) |
|---|---|---|---|
| Metal Alloy | | | |
| C-1 | 35 | 1.2 | 30 |
| C-2 | 78 | 3.5 | 22.3 |

TABLE 12-continued

| Hollow Tube Test Elastic Stress-Strain Rates | | | |
|---|---|---|---|
| Specimen | Stress (lb) | Deformation deflection (in) | Stress/strain (lb/in) |
| C-3 | 79 | 3.5 | 22.6 |
| C-4 | 64 | 2.8 | 22.9 |
| C-5 | 29 | 2.8 | 18 |
| C-6 | 49 | 2.4 | 20.4 |
| C-7 | 26 | 1.2 | 21.7 |
| C-8 | 25 | 1.2 | 20.8 |
| C-9 | 23 | 1.2 | 19.2 |
| C-10 | 30 | 1.6 | 18.8 |
| Split shaft hybrid | | | |
| C-11 | 59 | 2 | 29.5 |
| Composites | | | |
| C-12 | 34 | 3.1 | 11 |
| C-13 | 52 | 2.4 | 21.8 |

The sticks of this invention with stiffened cores and skin (A5, A6, A7, and A8) ranged in elastic stress-strain ratio over a factor of 2 from 5.5 to 11.8 pounds per inch (table 3), where the hollow tube alloy set (C1 to C13) also ranged almost a factor of 2 from a low of 18 to a high of 30 pounds per inch. Comparing the heaviest of the hollow metal tubes (C1) to the lightest of the test specimens (C5), the ratio of elastic stress-strains ratios 30/18=1.7 is comparable to the ratio of shaft weights 8.6/5.3=1.6. Since the lengths and cross-sections are the same, the resistance to bending varied directly with the wall thickness. The lowest of the alloy tubes had an elastic stress-strain ratio 18/11.8=1.53, which was 53 percent stiffer than the highest of the shafts of this invention, indicating that the shafts of this invention were about half as stiff as the hollow alloy tube products.

The shafts of this invention exhibited no plastic deformation up to structural failure except for the core with a square aluminum core stiffening element (A8). The square aluminum core stiffener had plastic deformation at 22 pounds force and 4.3 inch deflection. Thus, the point of plastic deformation and the structural failure point can be engineered by altering the core stiffener component. The stiffest shaft (A5) had a deformation of 6.7 inches and an 80 pounds stress at the point of structural failure.

The point of plastic deformation depended upon the shaft thickness and the properties of the alloy used. The hollow alloy tube shaft with the highest stiffness (C1) had a 30 pounds per inch stress-strain rate and exhibited permanent deformation at a stress of 35 pounds and a deflection of 1.2 inches. The three lightest specimens (C4, C5, and C6) had plastic on-set at a deflection of 3.5 inches and stress of about 80 pounds, showing they were more flexible. The remaining 70 percent of the alloy shafts exhibited plastic set with deflections under 2.0 inches. All hollow metal shafts failed plastically, taking a permanent set (bend) by 3.5 inches deflection. The shafts of this invention had about twice the flexibility of the hollow alloy tube shafts.

The split shaft hybrid (C8) responded to the bending force applied in the test very much like the strongest of the hollow alloy tubes (C1). The stress-strain ratio at structural failure was 32 pounds per inch for the split shaft hybrid compared to 30 pounds per inch for the hollow alloy tube.

For the two nonmetallic tube designs (C9 and C10) that weighed 7.1 ounces and 5.7 ounces, respectively, the elastic stress-strain ratios were 11 and 21.8 pounds per inch. Here, the ratio of the elastic stress-strain ratios was 11/21.8 pounds per inch=0.5 and the ratio of weights was 7.1/5.7=1.25, indicating that the stiffness of the composite designs did not vary as it did for the metallic tubes, where the stiffness varied directly with the weight, but rather it is a result of the design of the tube.

Example 8

Commercial Shafts, Stress-Strain at Failure

TABLE 13

| Hollow Tube Test Stress-Strain at Failure | | | | | |
|---|---|---|---|---|---|
| | Plastic Deformation | | Structural failure | | |
| Specimen | Stress (lb) | Deformation (in) | Stress (lb) | Deflection (lb) | Ratio |
| Metal Alloy | | | | | |
| C-1 | 35 | 1.2 | 151 | 5.1 | 30 |
| C-2 | 46 | 2.0 | 93 | 4.3 | 22 |
| C-3 | 36 | 1.6 | 100 | 5.1 | 20 |
| C-4 | 84 | 3.5 | 98 | 4.3 | 23 |
| C-5 | 70 | 3.5 | 78 | 3.9 | 20 |
| C-6 | 79 | 3.5 | 94 | 4.3 | 22 |
| C-7 | 50 | 2.0 | 94 | 3.5 | 27 |
| C-8 | 36 | 1.6 | 58 | 2.8 | 21 |
| C-9 | 33 | 1.6 | 50 | 3.1 | 16 |
| C-10 | 39 | 2.0 | 61 | 2.8 | 22 |
| Split shaft hybrid | | | | | |
| C-11 | 70 | 2.4 | 124 | 3.9 | 32 |
| Composites | | | | | |
| C-12 | 62 | 5.1 | 68 | 5.5 | 12.4 |
| C-13 | 78 | 3.5 | 85 | 3.9 | 22 |

The lowest structural failure stress-strain ratio was 16 and the highest 30. The average was 22.3.

Hollow metal tubes, when bent to folding, present sharp points at each side of the fold and, in the case of strong alloys, metal spall. In one case, a 3/16 by ½ inch long piece was forcefully ejected from the surface (C4).

The stress-strain ratios at structural failure were slightly higher than elastic for both C9 and C10.

The stiffer cores of the shafts of this invention affected the amount of force needed to cause structural failure. There was almost a factor of three from 3.9 to 12 pounds per inch in the bending stress-strain rate at structural failure for cores of different stiffness. The elastic strain varied from 5.1 to 6.7 inches of deflection (strain) for the stronger cores. The lowest structural failure stress-strain ratio for the hollow alloy tube was 16 and the highest 30 pounds per inch. The average was 22.3 pounds per inch, compared to 12 for the stiffest shaft of this invention. Thus, the shafts of this invention were about half as stiff as the hollow alloy tubes at failure by intent.

Hollow metal tubes when bent to folding present sharp points at each side of the fold and, in the case of strong alloys, metal spall. In one case a pieces 3/16 inches by ½ inches long was forcefully ejected from the surface of Specimen C1. The test shafts of this invention broke without producing sharp jagged edges at any point of failure. The lowest structural failure stress-strain ratio for the hollow alloy tubes was 16 pounds per inch and the highest was 30 pounds per inch. The average was 22.3 pounds per inch compared 12 for the stiffest shaft of this invention.

In all respects, the split shaft hybrid design was a subset of the hollow alloy tubes and performed similarly to the stiffest of the hollow alloy tube specimens.

The two hollow tube composites specimens were split in their performance. C8, the stiffest (elastic stress-strain ratio of 22 pounds per inch), performed at about the average of the hollow alloy tube shafts. C9, the less stiff hollow composite tube shaft, had the same elastic stress-strain ratio as the stiffest of the shafts of this invention, but it failed and broke at a deflection of 5.5 inches whereas the shafts of this invention flexed to 8.3 inches deformation before breaking and flexed (8.3/5.5=1.51) 51 percent farther than the comparable hollow tube composite design, a significant safety advantage.

Example 9

Frequency Range

Table 14 shows the frequency range from the impact test for the shafts of this invention.

TABLE 14

| Vibration Frequency content | | |
|---|---|---|
| Specimen | Type of core-skin | Frequency Range (kHz) |
| A5 | 0.060-in spar in balsa-Kevlar/carbon-Kevlar/carbon | 0 to 2 |
| A6 | 0.030-in spar in balsa-Kevlar/carbon-Kevlar/carbon | 0 to 2 |
| A7 | Round graphite tube in balsa-Kevlar-carbon-Kevlar/carbon | 0 to 1.5 |
| A8 | Square Aluminum tube in balsa-Kevlar/carbon-Kevlar/carbon | 0 to 1 |
| A9 | Balsa core-Kevlar/carbon-carbon/carbon | 0 to 2 |

Most of the impact-vibration energy in the shafts of this invention was concentrated in the lower frequencies (0 to 0.5 kilohertz) with little frequency content above 2 kilohertz and will transmit less shock than other shaft technologies to the hands of a player in a stick on stick impact. Lower frequency vibrations are felt more like a push than a hit in a stick on stick impact. All the hollow tube alloy specimens have a split in their frequency content with large fractions of their vibration energy concentrated in the 0 to 1 kilohertz and 4 to 5 kilohertz frequencies. The hollow composite designs have vibration energy concentrated in the lower frequencies (0 to 2 kilohertz) with little frequency content above 3 kilohertz. The frequency content in the composite hybrid was the same as the alloy hollow tube shafts, i.e., the energy was concentrated in the 0 to 1 kilohertz range and also at 4 to 5 kilohertz.

Example 10

Commercial Shafts, Decay Time & Frequency Range

To show the vibration test impact is consistently applied, the "Integrated Vibration Energy" called here the total power is listed in Table 15. The decay time is the time from the sharp rise to the background noise level.

TABLE 15

| Hollow Tube Vibration Test | | | | |
|---|---|---|---|---|
| Specimen | Total Power (-db) | Decay Time (sec) | Frequency Range (KHz) | Frequency Cconcentration Range (KHz) |
| Alloy Hollow Tube | | | | |
| C1 | 64.2 | 0.066 | 0 to 5 | 0 to 1 4 to 5 |
| C6 | 62.7 | 0.05 | 0 to 5 | 0 to 1 4 to 5 |
| C9 | 69.3 | 0.044 | 0 to 5 | 0 to 1 4 to 5 |
| Average | 65.4 | 0.053 | | |
| Hollow Composite Tube | | | | |
| C12 | 62.7 | 0.035 | 0 to 3 | 0 to 2 |
| C13 | 73.9 | 0.040 | 0 to 3 | 0 to 2 |
| Average | 68.3 | 0.0375 | | |
| Split Shaft Hybrid | | | | |
| C11 | 65.7 | 0.043 | 0 to 5 | 0 to 1 4 to 5 |

In Table 15 the similarity in total power shows the impact energy delivered to the sticks by the striker bar was comparable.

The decay time was 50 percent and 30 percent longer in the stronger hollow tube alloy design, C1 verses C6 and C9 that had the lower linear stress-strain rates (30 pounds per inch for C1 and 20.4 for C6 and 19.2 for C9).

Comparing averages from decay ranges that do not overlap, the alloy hollow tube shafts retained vibrational energy 0.053 seconds/0.035 seconds=1.51 or 51 percent longer than the shafts of this invention.

Comparing averages from decay ranges, the hollow composite tube shafts retained vibrational energy 0.0375 seconds/0.035 seconds=1.071 or 7.1 percent longer than the shafts of this invention.

Comparing the average of the decay range to the hybrid decay time, the hollow composite tube shaft retained vibrational energy 0.043 seconds/0.035 seconds=1.23 or 23 percent longer than the shafts of this invention.

The average decay time for the shafts of this invention with core stiffeners was 0.035 seconds. The decay times for the alloy hollow tube selected specimens ranged from 0.044 to 0.066 seconds with an average of 0.053 seconds.

This description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

The invention claimed is:

1. A process for making an athletic shaft comprising:

providing a shock-absorbing component having a polygonal outer surface, the shock-absorbing component comprising a core foam;

dividing the shock-absorbing component into a first and second portion;

forming a first channel in the first portion, the first channel having a first semicircular inner surface;

forming a second channel in the second portion, the second channel having a second semicircular inner surface;

applying an adhesive to the first and second channels of the shock-absorbing component;

using the adhesive, laminating an elongated stiffening component to the first and second channels, wherein the elongated stiffening component has a circular outer surface and comprises extruded unidirectional carbon fiber, and the shock-absorbing component encases the elongated stiffening component, and the first and second channel inner surfaces of the shock-absorbing component encases an outer surface of the elongated stiffening component without leaving any empty spaces between the first and second channel inner surfaces of the shock-absorbing component and the outer surface of the elongated stiffening component;

placing an outer skin component, comprising a carbon fiber fabric, over the shock-absorbing component and elongated stiffening component, wherein the outer skin component covers the outer surface of the shock-absorbing component without leaving any empty spaces between the outer skin component and the outer surface; and using a mold, imbedding an epoxy resin into the outer skin component.

2. The process of claim 1 wherein the polygonal outer surface is octagonal.

3. The process of claim 1 wherein the carbon fiber fabric comprises a weave of carbon fibers, the fibers extending in at least two different directions.

4. The process of claim 1 wherein the outer skin component further comprises polyamide fibers.

5. The process of claim 1 wherein the core foam comprises polyurethane.

6. The process of claim 1 wherein the core foam comprises polystyrene.

7. The process of claim 1 wherein the elongated stiffening component is a tube.

8. The process of claim 1 wherein the elongated stiffening component is a spar.

9. The shaft of claim 1 wherein the elongated stiffening component is made of a hollow tube having a wall thickness of at least about 0.01 inches.

10. The process of claim 1 wherein the elongated stiffening component and shock-absorbing component are each at least 25 inches long.

11. A lacrosse stick made from the process of claim 1.

12. A hockey stick made from the process of claim 1.

13. The process of claim 1 wherein the core foam comprises extruded polystyrene.

14. The process of claim 1 wherein a thickness of the core foam between the outer skin component and the elongated stiffening component is uniform.

15. The process of claim 1 wherein the elongated stiffening component is a tube having a circular cross section having an empty space within the tube.

16. The process of claim 1 wherein the elongated stiffening component has a stress-strain ratio of at least 3.9 pounds per inch at the point of structural failure.

17. The process of claim 1 wherein the shaft comprising a combination of the outer skin, shock-absorbing, and elongated stiffening components has the elastic stress-strain rate of at least 5.5 pounds per inch.

* * * * *